US008025090B2

(12) United States Patent
Kicher

(10) Patent No.: US 8,025,090 B2
(45) Date of Patent: Sep. 27, 2011

(54) GARAGE DOOR OPERATING APPARATUS AND METHODS

(76) Inventor: Paul Kicher, Willoughby Hills, OH (US)

( * ) Notice: Subject to any disclaimer, the term of this patent is extended or adjusted under 35 U.S.C. 154(b) by 0 days.

(21) Appl. No.: 11/582,807

(22) Filed: Oct. 18, 2006

(65) Prior Publication Data

US 2007/0137801 A1 Jun. 21, 2007

Related U.S. Application Data

(60) Provisional application No. 60/727,933, filed on Oct. 18, 2005, provisional application No. 60/735,914, filed on Nov. 10, 2005, provisional application No. 60/785,510, filed on Mar. 24, 2006.

(51) Int. Cl.
*E05F 15/00* (2006.01)

(52) U.S. Cl. ..... 160/191; 160/192

(58) Field of Classification Search ..... 160/188, 160/189, 191, 190, 192, 193; 16/67
See application file for complete search history.

(56) References Cited

U.S. PATENT DOCUMENTS

| | | | | | |
|---|---|---|---|---|---|
| 1,179,309 | A | * | 4/1916 | Henshaw | 242/602.1 |
| 1,530,762 | A | | 3/1925 | Dautrick | |
| 1,874,077 | A | * | 8/1932 | Anderson | 16/400 |
| 1,897,391 | A | | 2/1933 | Kelly | |
| 2,007,552 | A | * | 7/1935 | Vetterlein | 160/193 |
| 2,059,585 | A | | 11/1936 | Kelly | |
| 2,327,778 | A | * | 8/1943 | Wolf et. al. | 160/209 |
| 2,330,006 | A | | 9/1943 | Odenthal | |
| 2,533,423 | A | | 12/1950 | Bunch | |
| 2,534,525 | A | | 12/1950 | Molloy | |
| 3,165,143 | A | | 1/1965 | Jackwig | |
| 3,212,727 | A | * | 10/1965 | Borje Fonden Per et al. | 242/602.1 |
| 3,240,484 | A | | 3/1966 | Klamp | |
| 3,349,516 | A | | 10/1967 | Armstrong | |
| 3,468,060 | A | | 9/1969 | Mursinna | |
| 3,537,503 | A | | 11/1970 | Simmonds | |
| 3,853,205 | A | * | 12/1974 | Gindroz, Jr. | 187/260 |
| 4,102,382 | A | | 7/1978 | Vesbach | |
| 4,417,418 | A | | 11/1983 | Warning | |
| 4,642,845 | A | * | 2/1987 | Marshik | 16/194 |
| 4,683,677 | A | | 8/1987 | Jurgensen | |
| 4,891,908 | A | | 1/1990 | Aquilina | |
| 4,941,320 | A | | 7/1990 | Kersten et al. | |
| 5,040,332 | A | | 8/1991 | Aquilina | |
| 5,054,162 | A | * | 10/1991 | Rogers | 16/198 |
| 5,259,433 | A | * | 11/1993 | Cloutier | 160/190 |
| 5,280,818 | A | * | 1/1994 | Ubelhart | 160/265 |
| 5,365,636 | A | * | 11/1994 | Jensen | 16/67 |
| 6,561,256 | B2 | * | 5/2003 | Mullet | 160/191 |
| 6,735,820 | B1 | | 5/2004 | Teutsch | |
| 7,343,958 | B1 | * | 3/2008 | East et al. | 160/191 |
| 2003/0209333 | A1 | | 11/2003 | Olmsted | |
| 2005/0082015 | A1 | * | 4/2005 | Altimore | 160/133 |

* cited by examiner

*Primary Examiner* — Blair M. Johnson
(74) *Attorney, Agent, or Firm* — McDonald Hopkins LLC

(57) ABSTRACT

The present invention provides for apparatus and methods for operating a garage door. An embodiment of an operating assembly for a door includes a shaft, a graduated drum, and an energy storing member. The shaft is coupled to the door such that the shaft rotates in a first direction as the door is opened and rotates in a second direction as the door is closed. The coupling of the shaft to the door is typically accomplished by a cable. The graduated drum is coupled to the shaft and the energy storing member is coupled to the graduated drum by another cable. The energy storing member is arranged such that the energy storing member stores energy as the door is closed and releases stored energy as the door is opened to assist in the raising and lowering of the door.

10 Claims, 19 Drawing Sheets

GARAGE DOOR OPERATING APPARATUS AND METHODS

CROSS-REFERENCE TO RELATED APPLICATIONS

This application claims priority from U.S. Provisional Patent Application No. 60/727,933, titled TORQUE CONTROL SYSTEM AND METHOD, filed on Oct. 18, 2005; U.S. Provisional Patent Application No. 60/735,914, titled GARAGE DOOR LIFT SYSTEM AND METHOD, filed on Nov. 10, 2005; and U.S. Provisional Patent Application No. 60/785,510, titled GARAGE DOOR COUNTERBALANCE SYSTEM, filed on Mar. 24, 2006; all of which are hereby incorporated in their entirety by reference.

FIELD OF INVENTION

The present invention relates to garage door operating apparatus and methods, and more particularly, to apparatus and methods for influencing the force needed to raise and lower a garage door.

BACKGROUND OF INVENTION

The present invention is an improvement upon the invention disclosed in U.S. Pat. No. 6,983,785, issued on Jan. 10, 2006, and titled DOOR OPERATING MECHANISM AND METHOD OF USING THE SAME, which is hereby incorporated in its entirety by reference.

Most systems for operating garage doors utilize torsion springs to assist in lifting the garage door. Such torsion-spring-based systems function as follows. A shaft is normally located above the door opening. A pair of door drums are attached to the shaft. Cables connect the door drums to the garage door. As the garage door is raised, the cables wind around the drums; as the door is lowered, those cables unwind. A torsion spring is positioned along the shaft. One end of the torsion spring is connected to the shaft and the opposite end of the spring is anchored to the door opening. The torsion spring is preloaded during the installation process. This preloading provides the necessary torque to counterbalance or offset the torque that the garage door imposes on the shaft by its connection to the door drums. When the garage door is raised, the shaft rotates in a first direction, and the torsion spring releases stored energy, thus assisting in lifting the door. When the door is lowered, the shaft rotates in the opposite direction, and the torsion spring is reloaded with energy, thereby, assisting in offsetting the weight of the door and slowing its decent.

However, the use of torsion springs to assist in the lifting and lowering of garage doors offers disadvantages. For example, since torsion springs must be preloaded at installation, a technician performing that installation is exposed to risk of injury. If the technician overloads the torsion spring or the torsion spring includes a material defect, the spring may fail suddenly. Due to the preload, such a failure of a spring is unpredictable and may cause the spring to strike the technician or a garage surface with great force, causing significant bodily injury or property damage. In addition, the very process of preloading a torsion spring is difficult and laborious, and many individuals are physically incapable of completing such a task. Therefore, there is a need to replace torsion springs commonly used for garage door mechanisms with safer and easier apparatus and methods.

U.S. Pat. No. 6,983,785 discloses the use of gas springs as an alternative to torsion springs. A gas spring is fixed at one end and slideably mounted along a track on the opposite end. A cable connects the gas spring to a side drum, which is attached to the shaft above the garage door. As the door is lowered, the cable winds around the side drum, causing the gas spring to compress and store energy. This compression serves to counterbalance the weight of the door and slow the decent of the door. As the door is raised, the compressed gas spring extends and releases energy, pulling the cable attached to the side drum and assisting in lifting the door.

The present invention provides alternatives to the use of torsion springs in assisting the operation of a garage door. The elimination of torsion springs overcomes disadvantages in the prior art. In addition, the present invention provides for novel arrangements of apparatus and methods for using these alternatives to torsion springs.

SUMMARY OF THE INVENTION

The present invention provides apparatus and methods for operating a garage door. An embodiment of an operating assembly for a door includes a shaft, a graduated drum, and an energy storing member. The shaft is coupled to the door such that the shaft rotates in a first direction as the door is opened and rotates in a second direction as the door is closed. The coupling of the shaft to the door is typically accomplished by a cable. The graduated drum is coupled to the shaft, and the energy storing member is coupled to the graduated drum by another cable. The energy storing member is arranged such that the energy storing member stores energy as the door is closed and releases stored energy as the door is opened to assist in the raising and lowering of the door.

DETAILED DESCRIPTION

While the present invention is described with reference to embodiments described herein, it should be clear that the present invention is not to be limited to such embodiments. Therefore, the description of the embodiments herein is merely illustrative of the present invention and will not limit the scope of the invention as claimed.

The present invention provides novel arrangements and methods for assisting in the raising and lowering of garage doors. An embodiment of the present invention utilizes an energy storing device, preferably a gas spring, coupled to a drum to provide resistance force to counterbalance the weight of a door as it is lowered and to provide an assisting force to counterbalance the weight of door as it is raised. Another embodiment optionally utilizes an at least partially graduated drive drum to relay forces from an energy storing device to the garage door. Yet another embodiment arranges the gas spring so as to gain a mechanical advantage and limit the stoke needed by the spring to move the door between the open and closed positions.

Figure 1:
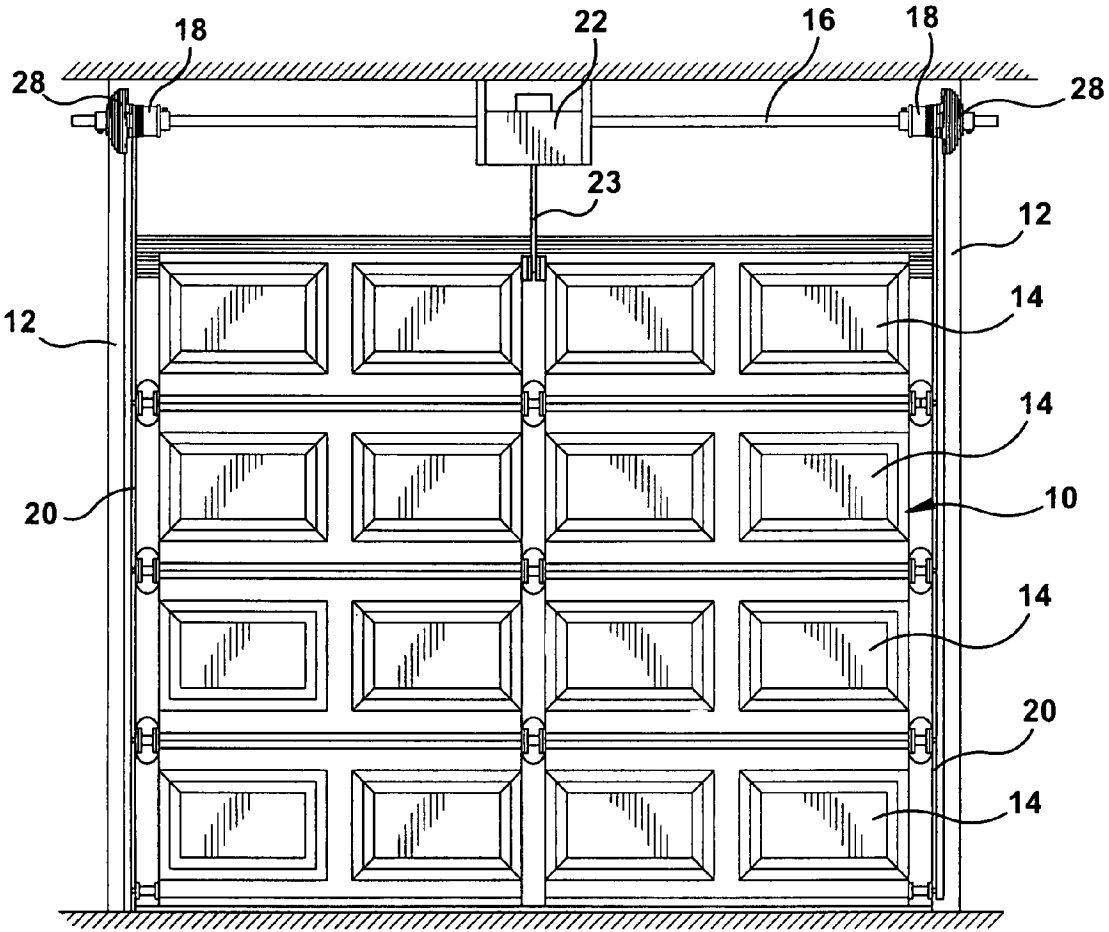
FIG. 1 is a rear elevation view of an exemplary embodiment of a garage door operating apparatus in accordance with the present invention.
Figure 2:
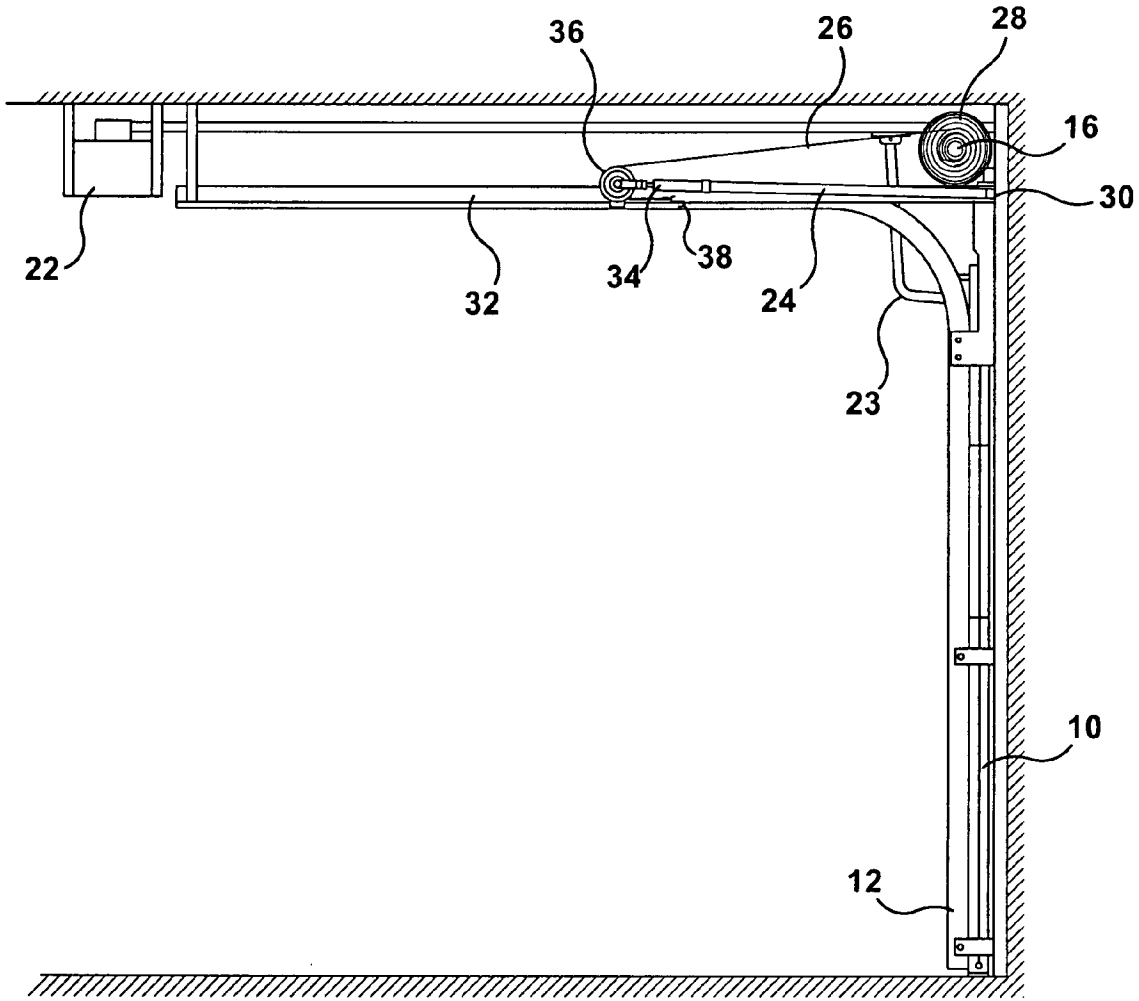
FIG. 2 is a side view of the garage door operating apparatus of FIG. 1.

FIGS. 1 through 4 illustrate an exemplary embodiment of the present invention. As shown in FIG. 1, a garage door 10 is arranged to be raised and lowered along a pair of tracks 12. As best seen in FIG. 2, the tracks 12 are generally L-shaped. To enable the door 10 to move along the L-shaped tracks 12, the door 10 includes a plurality of hinged panels 14. The mechanism by which the door 10 is raised and lowered includes a shaft 16, typically mounted to a garage wall above the door 10, and a pair of door drums 18 mounted on the shaft 16. As best seen in FIG. 1, a door drum 18 is mounted proximate to each end of the shaft 16, and door cables 20 connect each door drum 18 to the bottom of the door 10. As the shaft 16 rotates in a first direction, the door cables 20 wind around the door drums 18 and the door 10 rises. As the shaft 16 is rotated in the opposite direction, the door cables 20 unwind from the door drums 18 and the door 10 lowers. Optionally, a standard electric motor 22 is arranged to raise and lower the door 10. The motor 22 may be arranged to rotate the shaft 16 to raise and lower the door 10 or the motor 22 may be arranged to move a carriage coupled to the door 10 by an arm 23 (as seen in FIGS. 1 and 2) to raise and lower the door 10.

Figure 4:
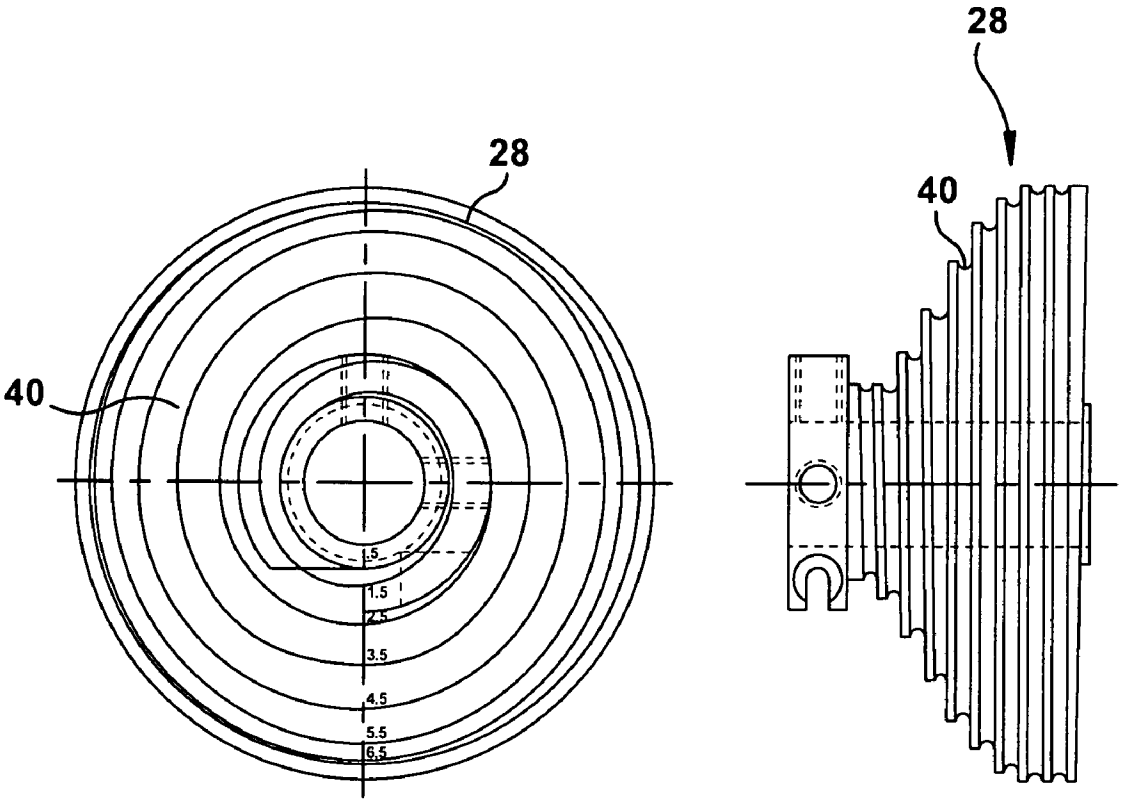
FIG. 4 is a top and side view of a nonlinear graduated drum for use with the garage door operating apparatus of FIG. 1.

As best seen in FIG. 2, an energy storing device 24 is coupled to the shaft 16 to assist in raising and lowering the door 10. In the preferred embodiment illustrated, the energy storing device 24 is a gas spring. The gas spring 24 is coupled to the shaft 16 through a spring cable 26 and a drive drum 28. One embodiment of the drive 28 is illustrated in FIG. 4. This illustration shows a nonlinear graduated drive drum 28. Although the present disclosure generally describes embodiments as including a nonlinear graduated drive drum, it will be readily understood by those skilled in the art that drive drums practiced with the present invention are not limited to nonlinear graduated drive drums. For example, drive drums practiced with the present invention can be linear graduated drums; flat drums with constant diameters; graduated drums, where a portion of the drum is linear and a another portion is nonlinear; and the like.

The gas spring 24 is fixed on a first end 30 and slideably coupled to a rail 32 on a second end 34. A pulley wheel 36 is attached to the slideable end 34 of the spring 24 to engage the gas spring 24 with the rail 32. The spring cable 26 is secured to the graduated drum 28 at one end. The spring cable 26 extends from the graduated drum 28, around the pulley wheel 36, and is secured to the rail 32 by a hook 38.

The gas spring 24 is arranged such that as the door 10 is lowered, the spring cable 26 winds around the graduated drum 28, and the spring 24 compresses and pressurizes to store energy. As the door 10 is raised, the spring cable 26 unwinds from the graduated drum 28 and the gas spring 24 extends and releases stored energy. As the electric motor 22 is actuated to raise the door 10, the shaft 16 begins to rotate, which unwinds the spring cable 26 from the graduated drum 28. This movement allows the gas spring 24 to extend and release stored energy. The release of this energy assists the shaft 16 in rotating, thus assisting in lifting the door 10. Conversely, when the door 10 is in an open or raised position, the spring cable 26 is unwound from the graduated drum 28 and the spring 24 is extended. As the electric motor 22 is actuated to lower the door 10, the shaft 16 begins to rotate in the opposite direction, which winds the spring cable 26 on the graduated drum 28. This movement compresses the gas spring 24, which stores energy. This storing of energy resists the rotation of the shaft 16, thereby slowing movement of the door 10 as it is lowered.

Although the present disclosure generally describes embodiments as including a gas spring that compresses to store energy and extends to release energy, it will be readily understood by those skilled in the art that energy storing devices practiced with the present invention are not limited to compression gas springs. Generally, the present application can be practices with any energy storing device that can store and subsequently release energy. For example, the present invention may be practiced with a gas spring that is arranged to extend when storing energy and contract (or compress) when releasing energy.

Figure 5:
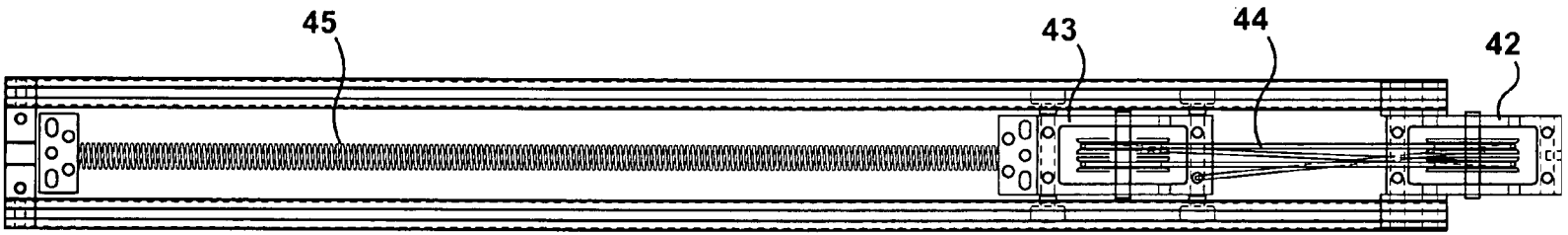
FIG. 5 is a top view of an energy storing apparatus arranged for use with the present invention.
Figure 6:
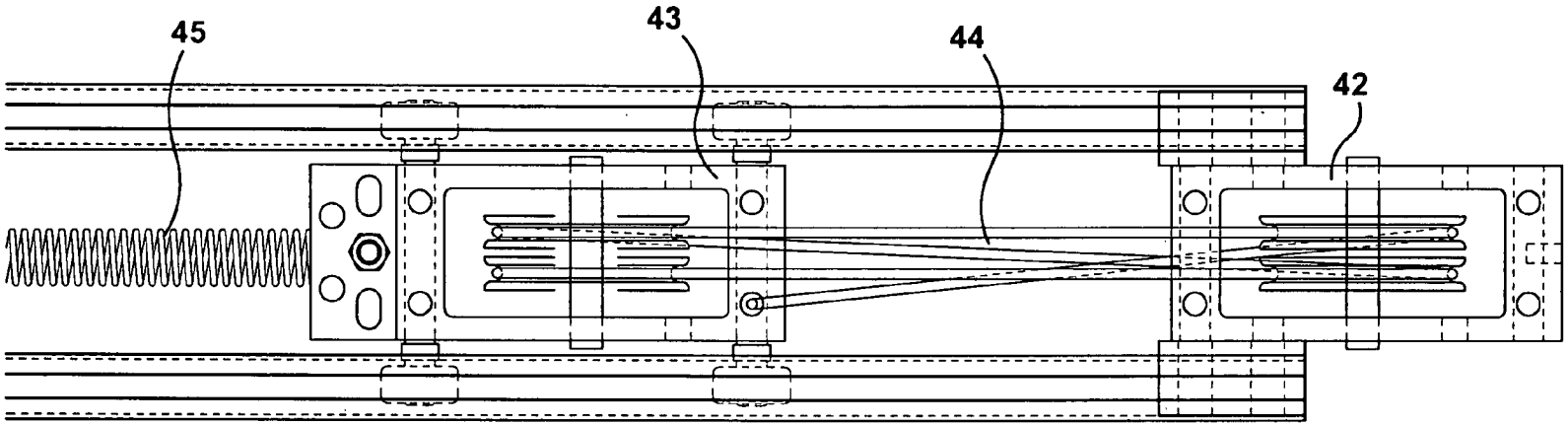
FIG. 6 is a detailed view of the energy storing apparatus of FIG. 5.

Exemplary embodiments of alternative energy storing apparatus are illustrated in FIGS. 5 through 8. FIGS. 5 and 6 illustrate a fixed carriage 42 and a slideable carriage 43 coupled by a cable 44. A coil spring 45 is attached to the slideable carriage 43 on a first end and fixed on a second end. The carriages 43, 44 and spring 45 may be arranged such that when the cable 44 moves in response to the lowering of a garage door, the slideable carriage 43 moves towards the fixed carriage 42 and the coil spring 45 extends, thus storing energy. As the garage door is raised, the cable 44 allows the slideable carriage 43 to move away from the fixed carriage 42, allowing the spring 45 to contract and release stored energy.

Figure 7:
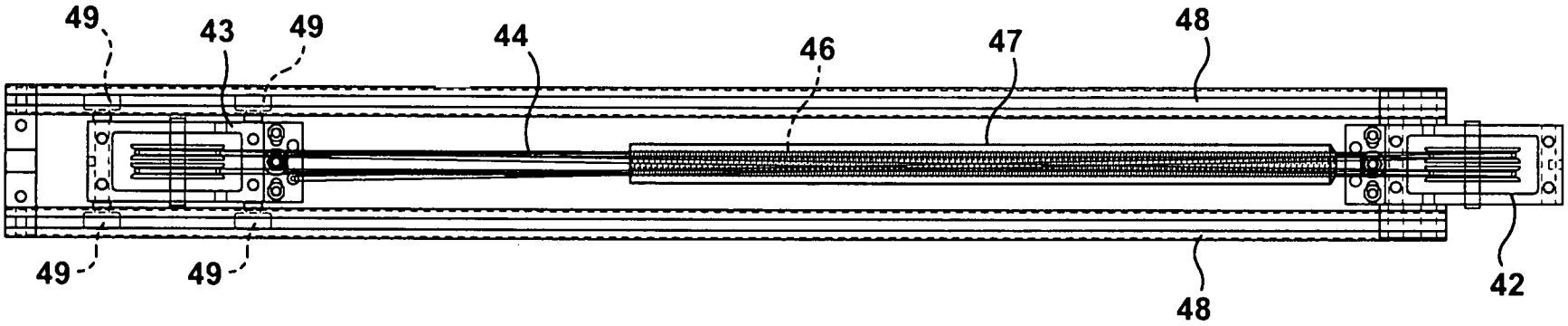
FIG. 7 is a top view of another energy storing apparatus arranged for use with the present invention.
Figure 8:
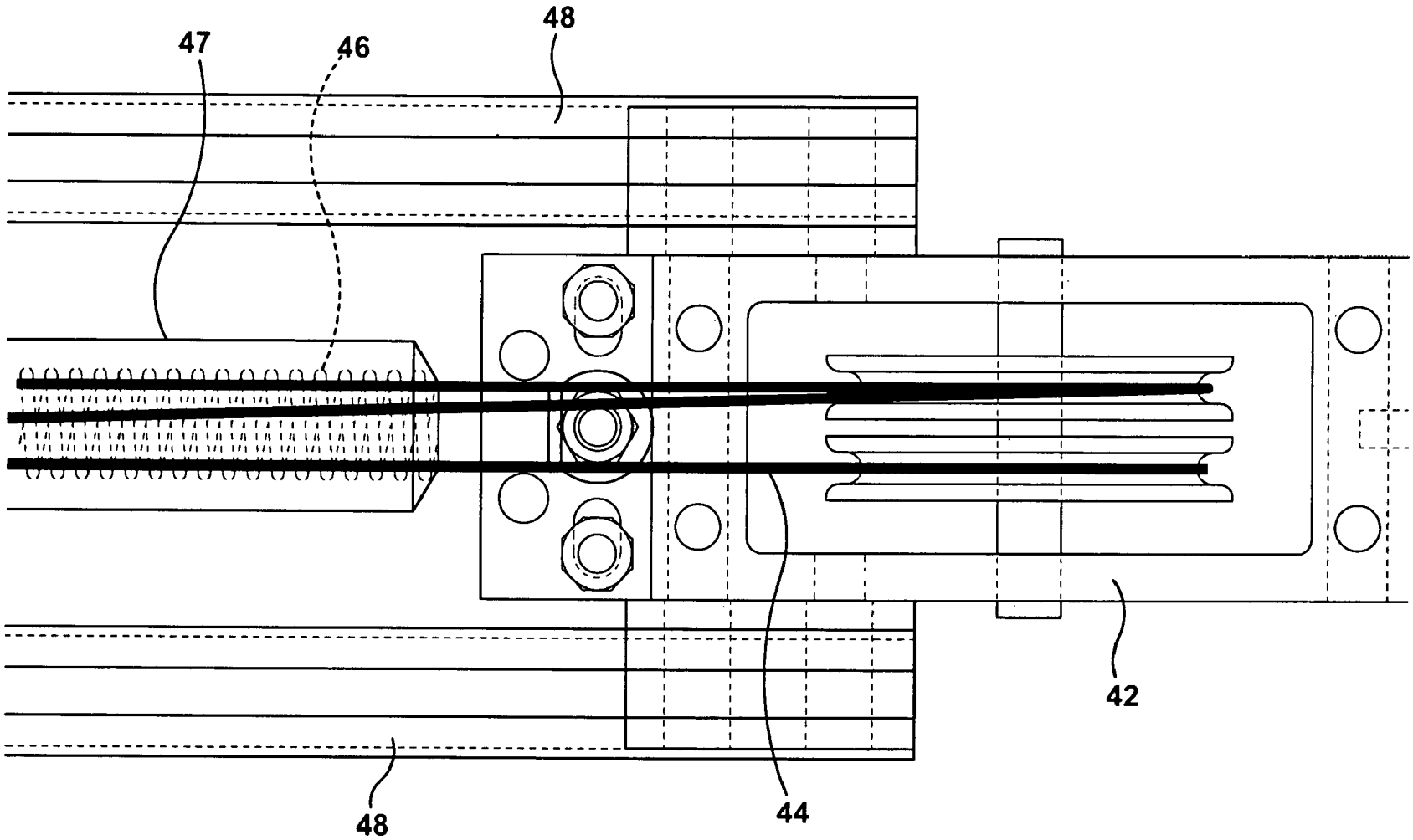
FIG. 8 is a detailed view of the energy storing apparatus of FIG. 7.

FIGS. 7 and 8 illustrate an arrangement utilizing a tension spring 46 located within a housing 47. This embodiment also includes a slideable carriage 43 coupled to a fixed carriage 42 by a cable 44, with the housing 47 positioned between the carriages 42, 43. The tension spring 46 and housing 48 are arranges such that when the slideable carriage 43 moves away from the fixed carriage 42, the spring 46 extends and stores energy and when the slideable carriage 43 moves towards the fixed carriage 42, the spring 46 contracts and releases stored energy. In this arrangement, the slideable carriage 43 moves away from the fixed carriage 42 when a garage door is closed, causing the spring 46 to store energy. The slideable carriage 43 moves towards the fixed carriage 42 when the garage door is raised, causing the spring 46 to release stored energy. A compression spring may also be used with a housing. The compression spring and housing may also be arranges such that when the slideable carriage 43 moves towards from the fixed carriage 42, the compression spring contracts to store energy and when the slideable carriage 43 moves away from the fixed carriage 42, the spring extents to release energy.

As shown in FIGS. 5 though 8, the slideable carriage 43 is coupled to tracks or rails 48 by a series of rollers 49, to assist in aligning the carriages 42, 43 and the spring 45, 46. However, as one skilled in the art will readily recognize, such systems may be arranged to be self-aligning and may be implemented without the need for any rails 48 or rollers 49 to align the energy storing device or carriages.

Figure 3:
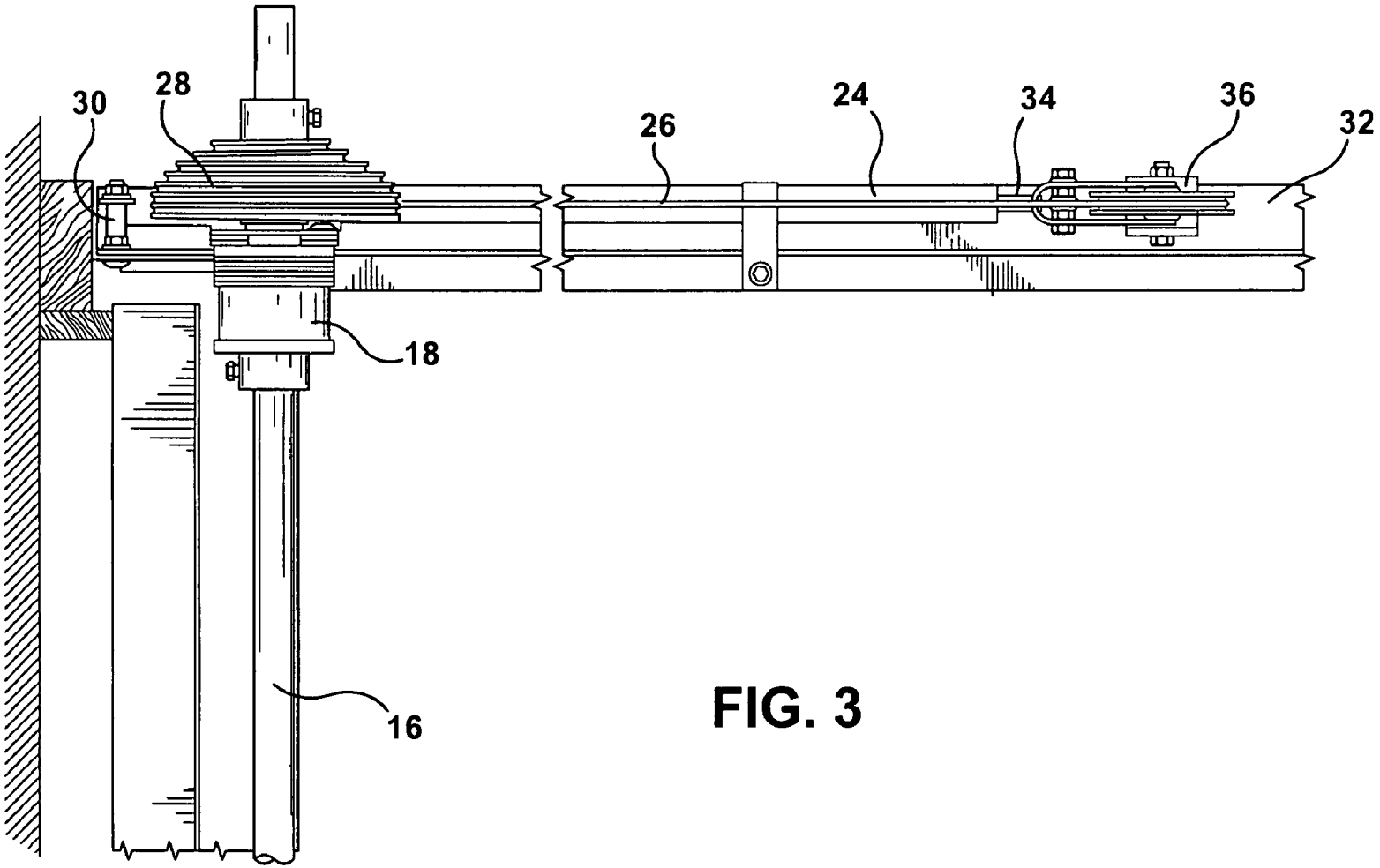
FIG. 3 is a detailed top view of the garage door operating apparatus of FIG. 1.

As illustrated in FIGS. 2 and 3, a mechanical advantage of 2 to 1 is achieved. For every inch of stroke the gas spring 24 provides, two inches of spring cable 26 winds on or off the graduated drum 28 attached to the shaft 16. For every pound of force the gas spring 24 applies to the slideable end 34, a half-pound of force is applied to the graduated drum 28.

Whether a garage door is operated by an electric motor, opened and closed manually, or by some other mechanism, there are force profiles (i.e., the force required to move the door as a function of the door position) that produce preferred behavior. For example, when manually opening a door, it is preferable that the force needed to raise the door from the closed to the open position is constant for the first 90% to 95% of the travel of the door, and the final 5% to 10% of the travel of the door requires no additional force from the operator. In other words, the door pulls itself up the last 5% to 10% of the travel distance. This arrangement provides the operator with confidence that the door will not fall back down, thereby avoiding physical injury or property damage.

This preferred force profile may be achieved through the use of the nonlinear graduated drum 28 illustrated in FIG. 4. The nonlinear graduated drum 28 includes a helical or spiral groove 40. The dimensions of the groove 40 change as the groove 40 progresses outward from the center of the drum 28.

Optionally, the nonlinear graduated drum 28 is used with a gas spring 24 that has a force ratio of 1.37 (i.e., a 200 lbs. spring creates a 274 lbs. force when fully compressed). The drum 28 is arranged such that 6.5 revolutions of the drum 28 move the door 10 between fully open and fully closed positions.

Figure 9:
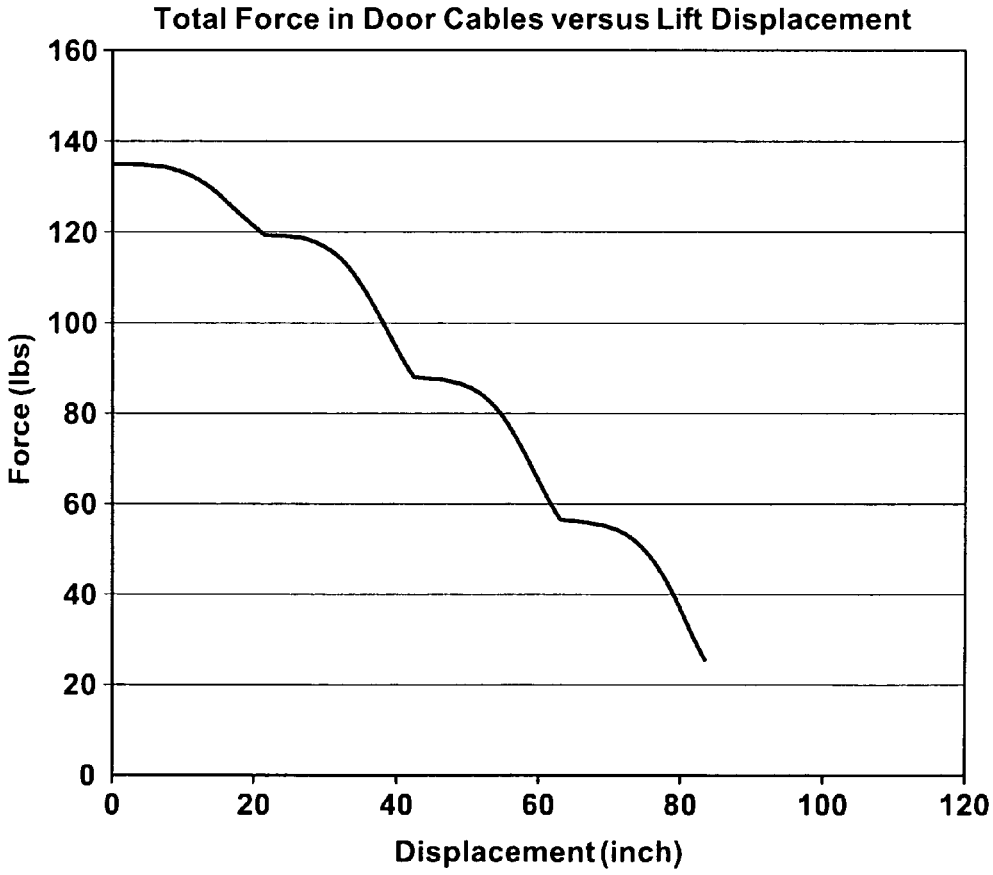
FIG. 9 is a graph illustrating a predicted relationship between force and displacement for unassisted moving of a 138 pound garage door from a closed to an open position.
Figure 10:
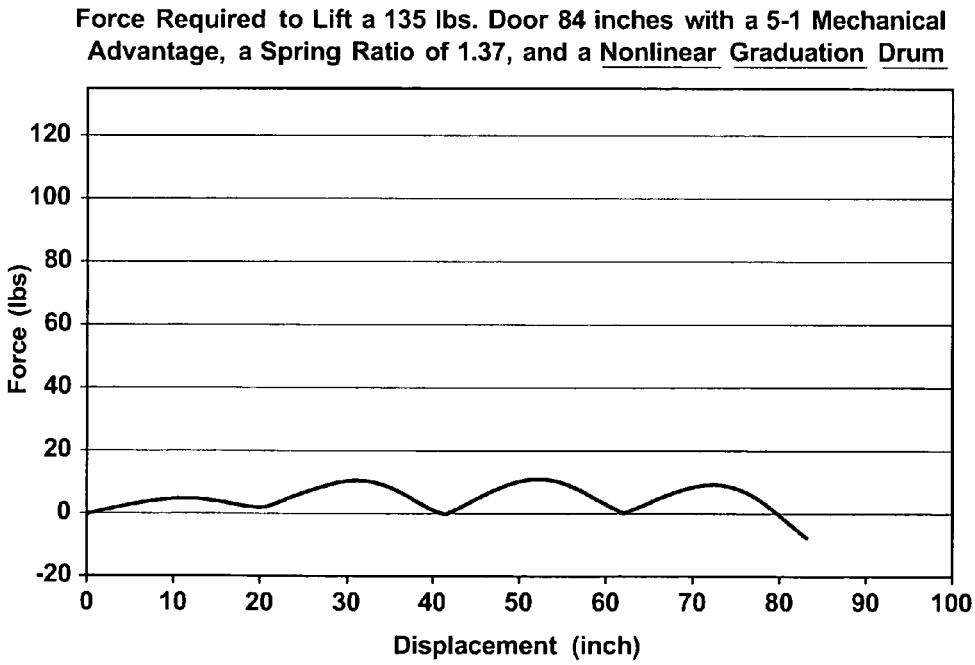
FIG. 10 is a graph illustrating a predicted relationship between force and displacement for moving a 138 pound door from a closed to an open position with the assistance of an embodiment of the present invention.

FIG. 9 illustrates a graph predicting the force required as a function of displacement to move a 138 pound 7 foot garage door from a closed to an open position without the assistance of a torsion spring, gas spring, etc. As can be seen, to initially move the door requires a relatively high force and the force needed to continue to move the door falls off rapidly. FIG. 10 illustrates a graph predicting the force required as a function of displacement (from 0 to 84 inches) to raise a 138 pound 7 foot with the assistance of the nonlinear graduated drum, shown in FIG. 4, and a gas spring with a spring ratio of 1.37 and arranged to have a mechanical advantage of 5 to 1. As can be seen, the force needed to move the door between 0 and 80 inches is low and relatively constant. When the door is moved further than 80 inches, the force needed to move the door becomes negative, and the gas spring pulls the door the remaining 4 inches. This arrangement meets the preferred criteria of a low and generally constant force for the approximately the first 90% to 95% of the distance the door travels, with the final 5% to 10% of the travel requiring no additional force from the operator.

Figure 11:
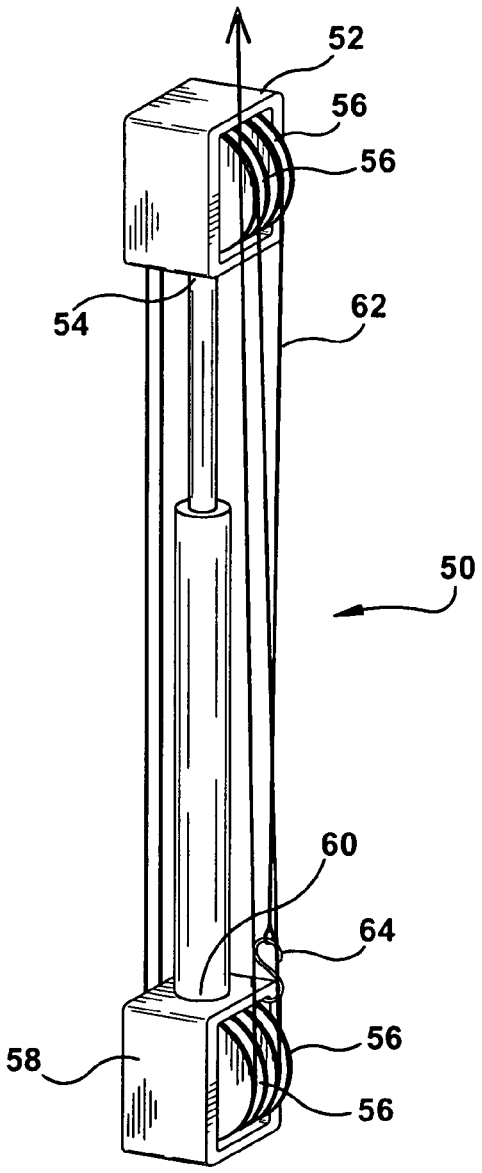
FIG. 11 is an exemplary embodiment of the present invention with a 5 to 1 mechanical advantage, utilizing a gas spring.

FIG. 11 illustrates an arrangement of a gas spring 50 that yields a 5 to 1 mechanical advantage. To achieve the 5 to 1 advantage, a first housing 52 is positioned at one end 54 of the spring 50 to secure two sheaves 56, and a second housing 58 is positioned at the opposite end 60 of the spring 50 to secure two sheaves 56. A cable 62 secured to the second housing 58 by a hook 64 is passed through the sheaves 56 as shown. In this arrangement, the stoke of the gas spring 50 need only be approximately one-fifth of the distance the garage door is moved between the fully open and fully closed positions.

The height of the door will determine the displacement needed to move a door from a closed to an open position. Most commonly, garage doors are manufactured in 7 foot and 8 foot heights. In implementing a drive drum system, whether the drum is nonlinear, linear, graduated, flat or any combination thereof, maintenance of a constant number of shaft rotations in moving a door from the closed to the open position is preferred. Otherwise, a different drive drum would need to be manufactured for each door height, which may lead to the need for different lengths of gas springs. It is preferable to maintain a consistent graduated drum and gas spring. Door drums are typically 4 inches in diameter, which requires approximately 6.5 revolutions to open a 7 foot door and 7.5 revolutions to open an 8 foot door. To maintain consistent drive drums and gas springs, the 4 inch door drum is used with 7 foot doors and a 4.58 inch door drum is used with 8 foot doors. This results in the shaft rotating 6.5 times regardless of whether the height of the door is 7 or 8 feet. It will be immediately recognized that the door drum may be adjusted for doors of any size to maintain 6.5 shaft revolutions to move a door from a closed to an open position.

It is preferable to use a spring with more stroke available than needed. For example, with the graduated drum 28 illustrated in FIG. 4 and a 5:1 mechanical advantage arrangement, only 12.75 inches of stroke are needed to rotate the graduated drum 6.5 revolutions to move the door between the open and closed positions. If a spring with a stroke of 16.14 inches is used, there will be 3.39 inches remaining to allow for fine adjustments to the force. The spring could start partially compressed to 3.39 inches and still have enough stroke remaining for 6.5 revolutions.

Figure 12:
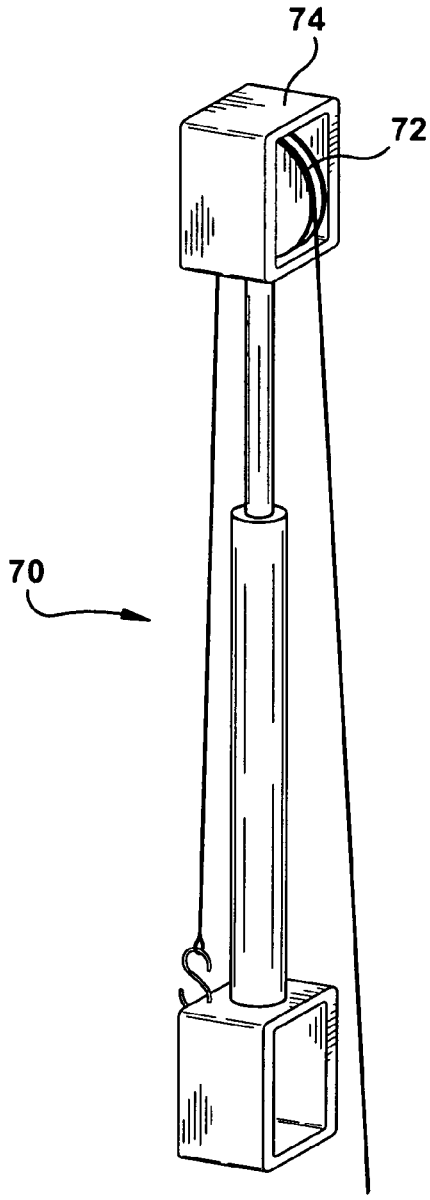
FIG. 12 is an exemplary embodiment of the present invention with a 2 to 1 mechanical advantage, utilizing a gas spring.

As shown in FIG. 12, a gas spring 70 may include a sheave 72 and housing 74 arrangement that results in a 2 to 1 mechanical advantage. It will be understood by those skilled in the art that a variety of mechanical advantage ratios may be achieved with varying arrangements of housing and sheaves coupled with gas springs. For example, an arrangement of three sheaves at one end of a gas spring and two sheaves at the opposite end yields a 6 to 1 mechanical advantage. In this arrangement, a 7 foot door would require a spring with approximately a 14 inch stroke.

Figure 13:
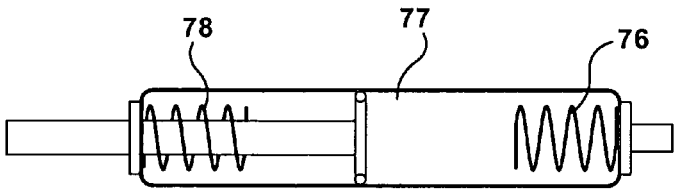
FIG. 13 is an exemplary embodiment of a coil-spring-modified gas spring for use with the present invention.
Figure 14:
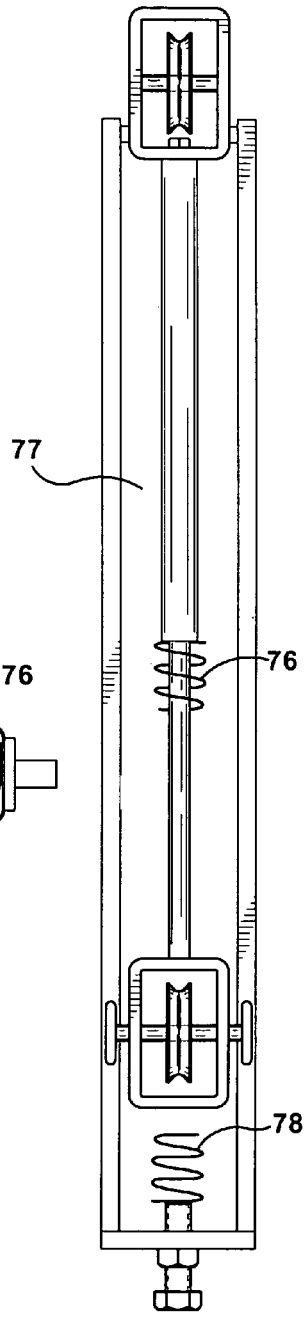
FIG. 14 is an exemplary embodiment of another coil-spring-modified gas spring for use with the present invention.

Referring again to FIG. 9, the force needed to move a door is nonlinear and quickly decreases as the door is moved from a full vertical position to a horizontal position. This nonlinearity could be addressed by adding coil springs to a gas spring. As seen in FIGS. 13 and 14, a first coil spring 76 can be added to the gas spring 77 to increase the force provided when the gas spring 77 is fully compressed and the garage door is closed. The first coil spring 76 can be located within the gas spring 77 (see FIG. 13) or outside of the gas spring 77 (see FIG. 14). A second coil spring 78 can be added to the gas spring 77 to adjust the force on the gas spring 77 when the gas spring 77 is extended and the garage door is nearly fully open.

Similarly, the second coil spring 78 can be located within the gas spring 77 (see FIG. 13) or outside of the gas spring 77 (see FIG. 14).

Figure 15:
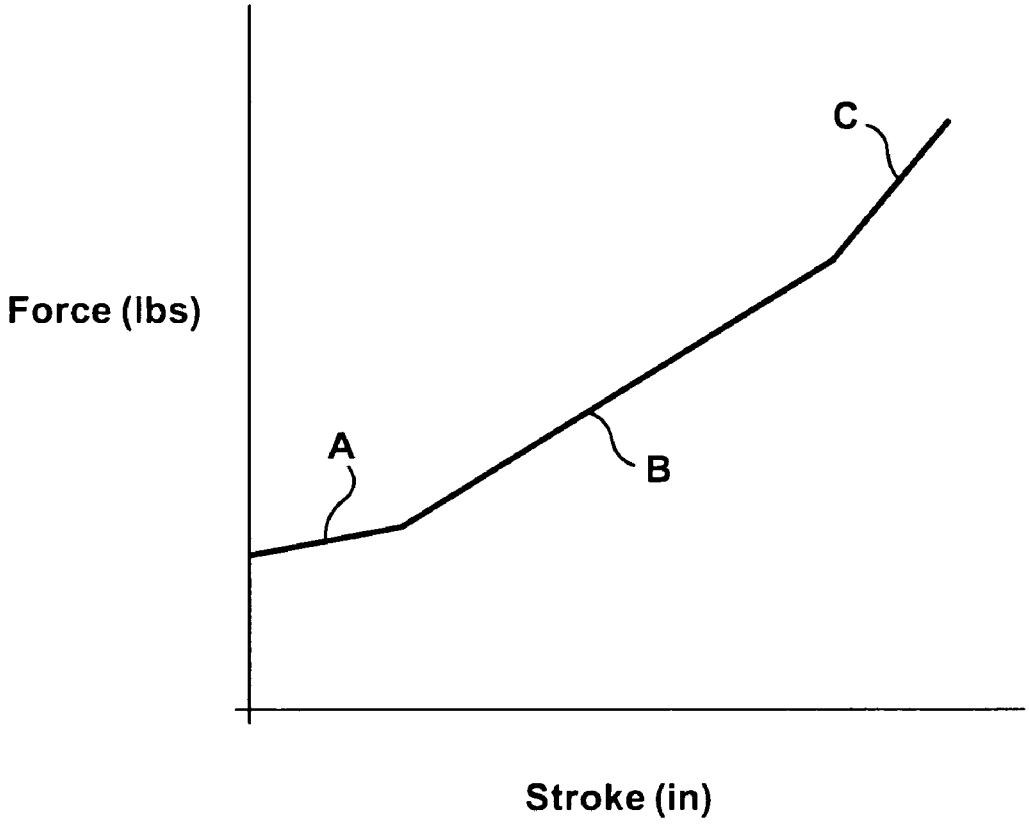
FIG. 15 is an graph illustrating the relationship between force and stroke displacement of a gas spring modified by coil springs.
Figure 16A:
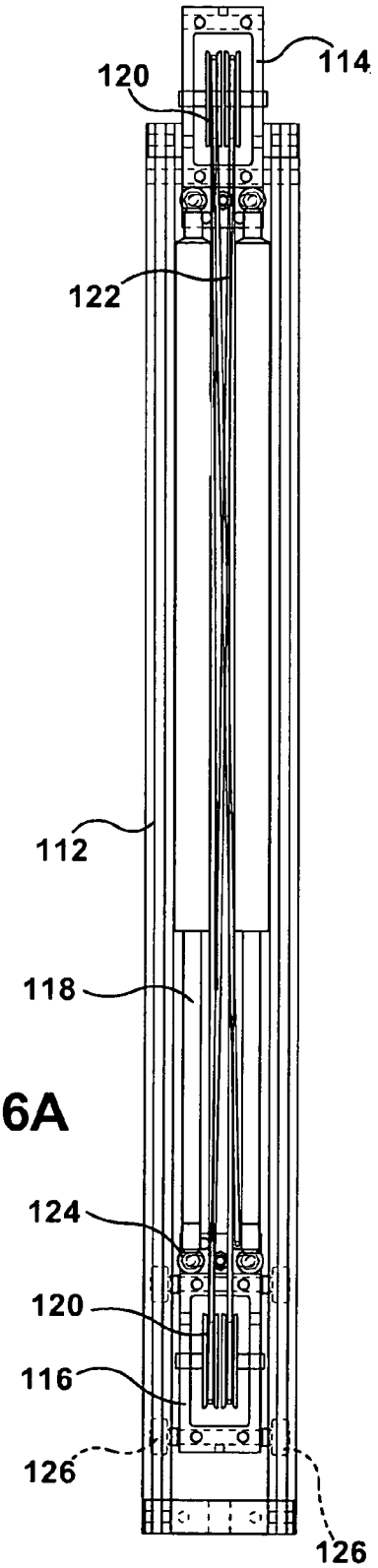
FIG. 16 is a top and front view of an exemplary embodiment of a modular garage door counterbalance assembly in accordance with the present invention.
Figure 16B:
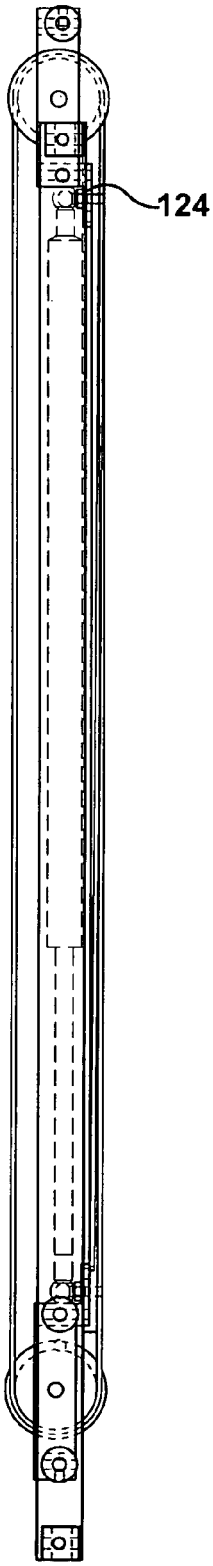
Figure 17:
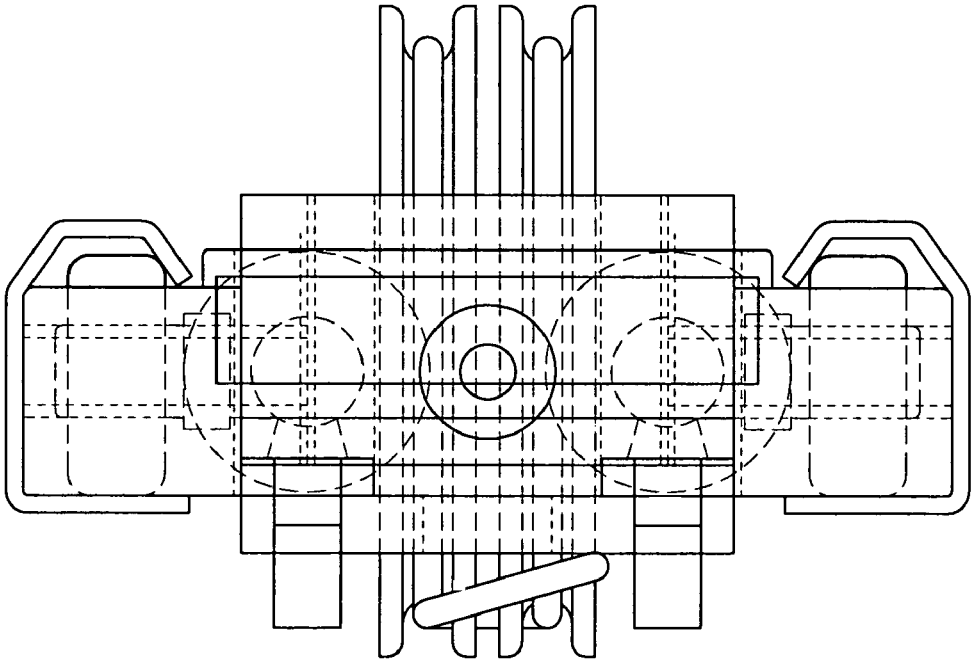
FIG. 17 is a side view of the modular garage door counterbalance assembly of FIG. 16.
Figure 18A:
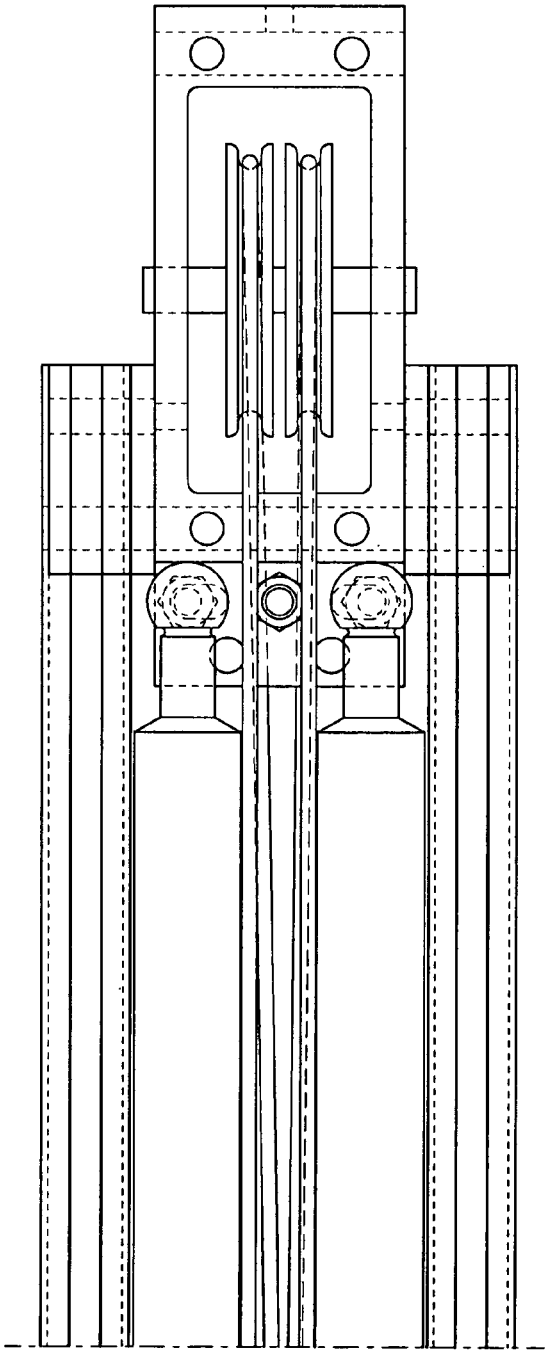
FIG. 18 is a detailed view of the modular garage door counterbalance assembly of FIG. 16.
Figure 18B:
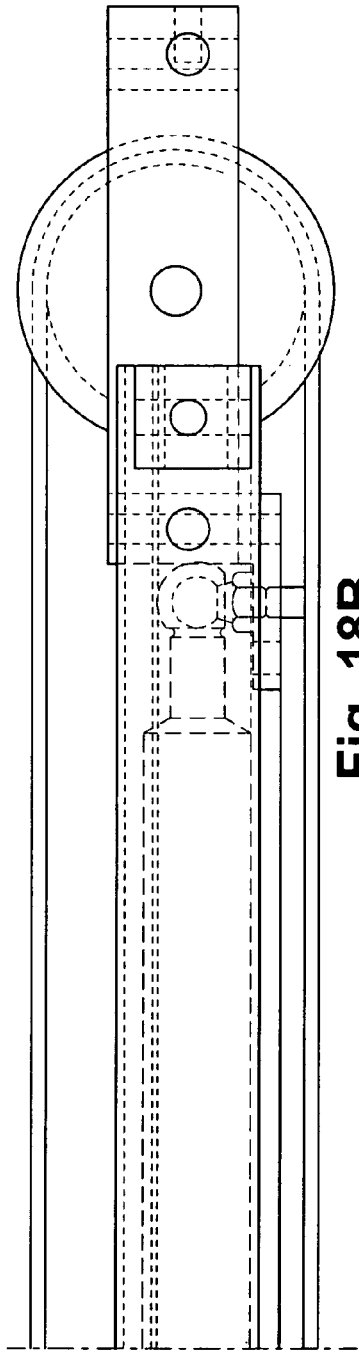
Figure 19A:
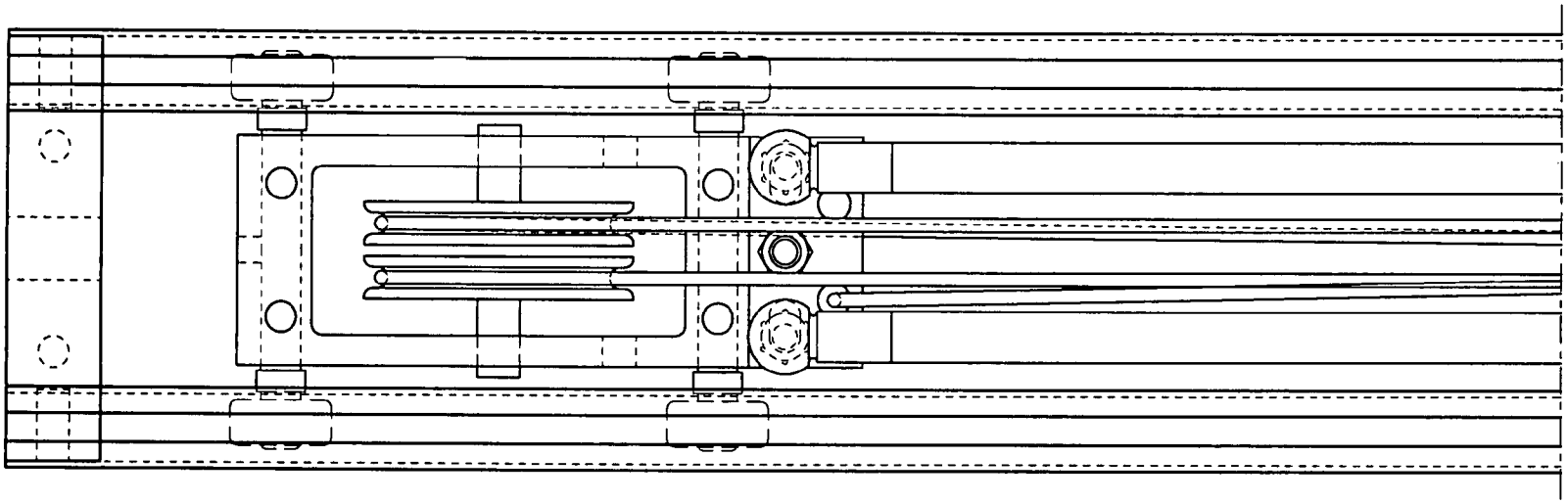
FIG. 19 is a detailed view of the modular garage door counterbalance assembly of FIG. 16.
Figure 19B:
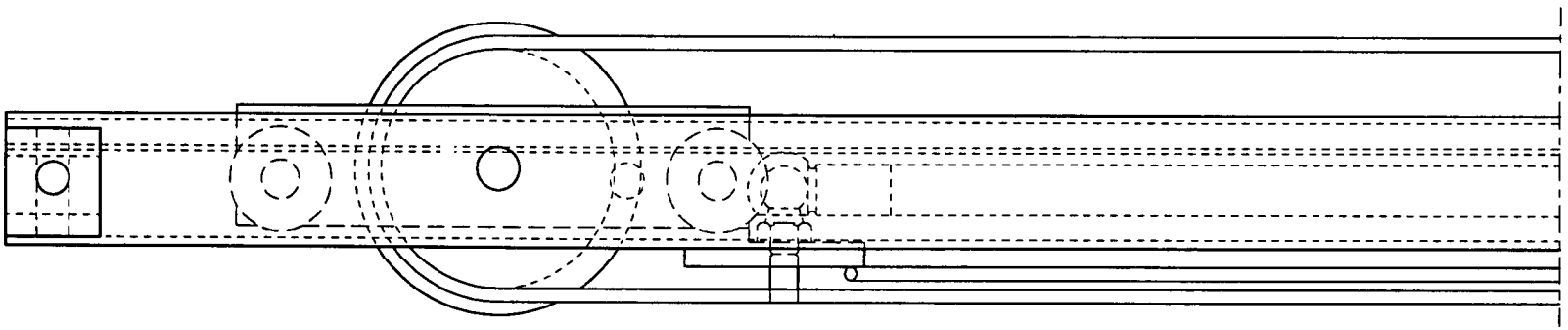

FIG. 15 shows a graph of force as a function of stroke displacement of the gas spring 77 fitted with a pair of coils springs 76, 78. The graph shows three linear portions: a first portion A, where the gas spring 77 is extended and influenced by the second coil spring 78; a second portion B, where the gas spring 77 is not influenced by either coil spring 76, 78; and a third portion C, where the gas spring 77 is compressed and influenced by the first coil spring 76. As can be seen, the second spring 78 can be arranged to lessen the slope of the force v. displacement curve (portion A) and the first spring can be arranged to increase the force v. displacement curve (portion C). The graph shown in FIG. 15 is exemplary and it will be readily understood by those skilled in the art that both tension and compression springs may be arranged with gas springs to effect the force generated by the gas spring. Such arrangements may increase or decrease the force provided when the gas spring is extended, and such arrangements may also increase or decrease the force provided when the spring is compressed.

As shown in FIGS. 16 through 22, an embodiment of the present invention includes a modular garage door counterbalance assembly 100. A modular assembly provides the advantage of quick and easy installation of a new garage door system or retrofitting of an existing garage door system.

The assembly 100 comprises at least one guide rail 112, a stationary carriage 114, a slideable carriage 116, and an energy storage device 118, preferably a gas spring, however, any energy storing device can be used. The stationary 114 and slideable 116 carriages are interconnected by the gas spring 118. In the preferred embodiment, each carriage 114, 116 utilizes sheaves 120 as a pulley system to accommodate a cable 122 therebetween. The slideable carriage 116 is attached to the guide rail 112 by at least one roller 126, although two or more rollers may be optionally used. As such, the modular assembly 100 can be mounted to a guide track of the garage door with a cable connection between the sheaves 120 and a graduated drum attached to a shaft, such as the one disclosed herein. This arrangement provides a compact, modular, and easy-to-install garage door counterbalance system.

Specific features of the modular assembly 100 are pointed out to fully describe the inventions disclosed herein. For example, to reduce friction in both the gas springs and the track and carriage system, a hinge connection at both ends of the gas springs has been provided to prevent an undesirable binding or friction effect that occurs within the gas spring components. A ball stud 124 is located on both slideable and stationary carriages. A mating socket is threaded onto the ends of the gas spring. The height of the ball stud 124 creates an offset from its mounting location. If the system uses, for example, a 3 to 1 or 5 to 1 mechanical advantage, the slideable carriage 116 may need to be balanced to reduce the normal forces in the rollers 126, thus reducing friction and wear. The combination of an odd mechanical advantage (i.e., 3 to 1, 5 to 1, etc.) and a ball stud requires the designer to pay attention to dimensions so as not to unnecessarily add the frictions previously mentioned.

Figure 21:
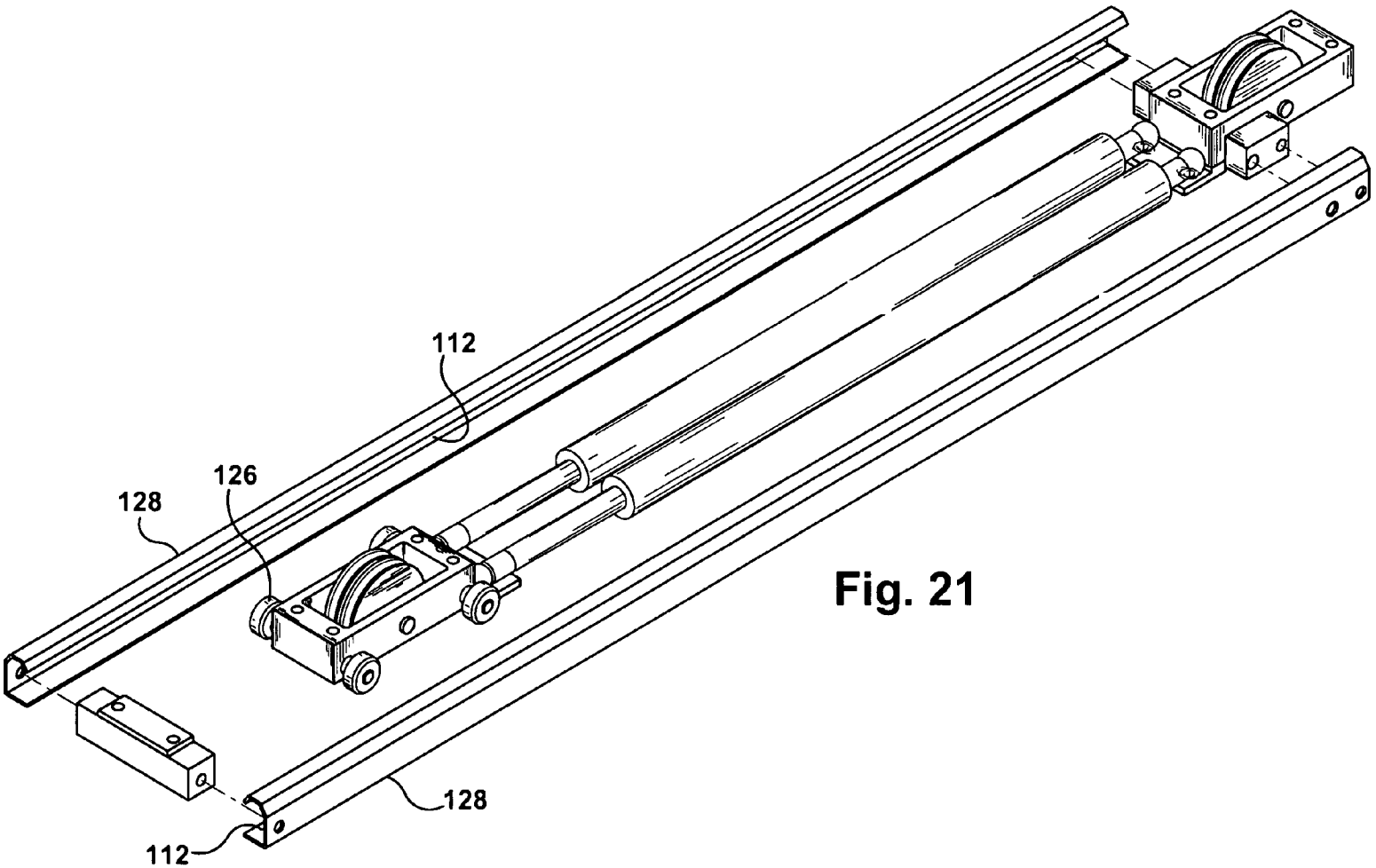
FIG. 21 is an exploded view of the modular garage door counterbalance assembly of FIG. 16.
Figure 22:
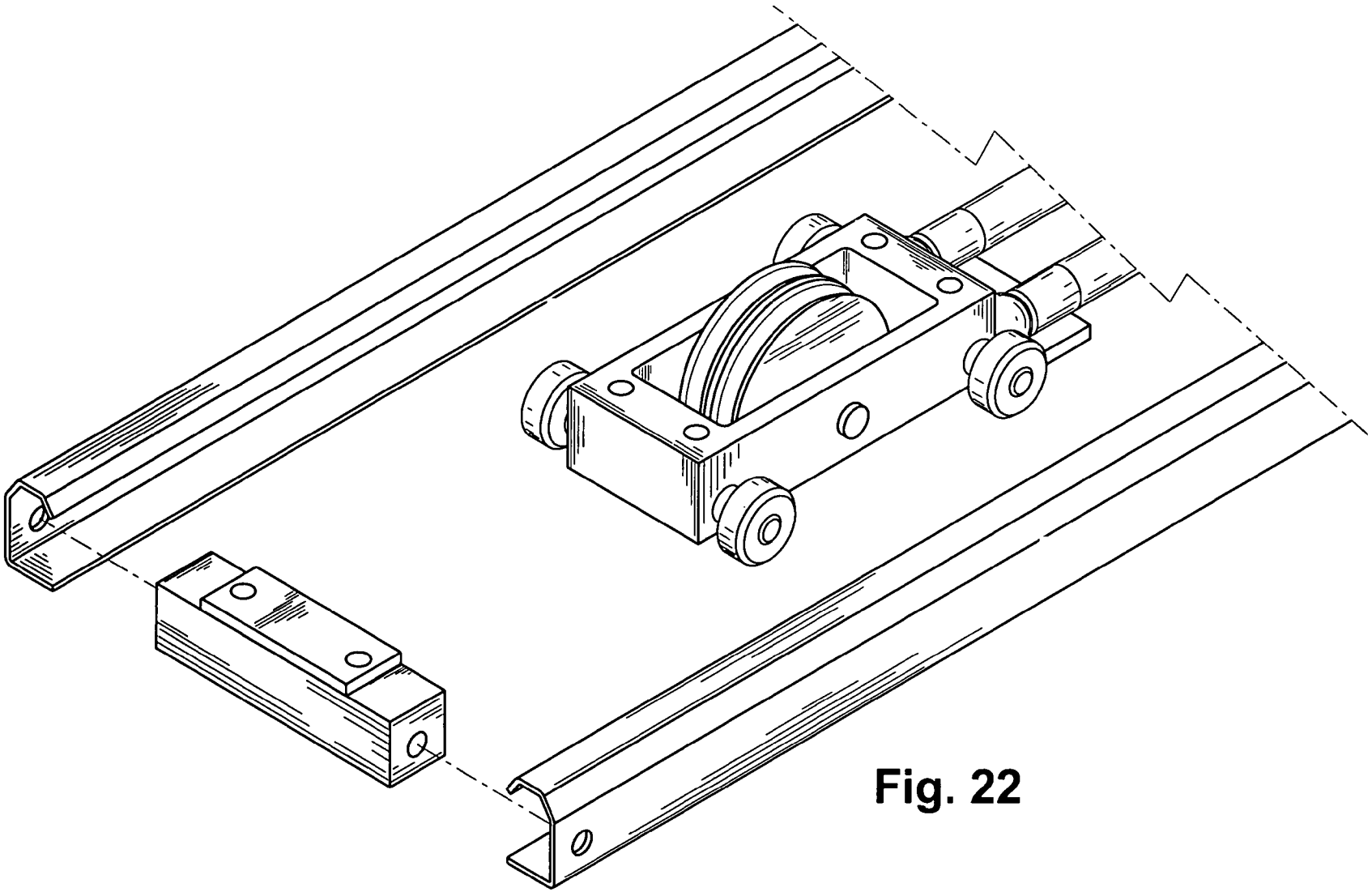
FIG. 22 is a detailed exploded view of the modular garage door counterbalance assembly of FIG. 16.

Further, as best shown in the exploded view in FIG. 21, the guide rail 112 includes an inner rounded lip 128 that retains the rollers 126 so that the rollers 126 can engage only the inner rounded lip 128 when in motion, thereby reducing the amount of friction previously created when the rollers 126 contacted both the inner and outer portions of the guide rails 112. Further, as shown in the figures, it is preferable to utilize a pair of guide rails 112 as, in the preferred embodiment, the pair of rails 112 assist in creating the modular assembly 100 completely out of functional parts.

As an example utility of the system, using a 5 to 1 mechanical advantage with two 250 lbs gas springs with a ratio of 1.37, the forces in the various components are as follows: the two springs, when fully compressed provide 685 lbs; each cable wrap provides 137 lbs; and, since four of the wraps apply their force to the carriage through the sheave pin, the sheave pin applies 548 lbs to the carriage. Due to the multiple cable wraps, the last wrap that ends on the slideable carriage must be offset to prevent the cable from rubbing with other wraps. If the carriage is not properly balanced, a torque will be created, and the reaction to this torque will be applied to the rollers as they make contact with the track. Torques about other axes should also be minimized, i.e. the torque created from the cable fleet angle as the drive cable walks down the torque control device.

Figure 20:
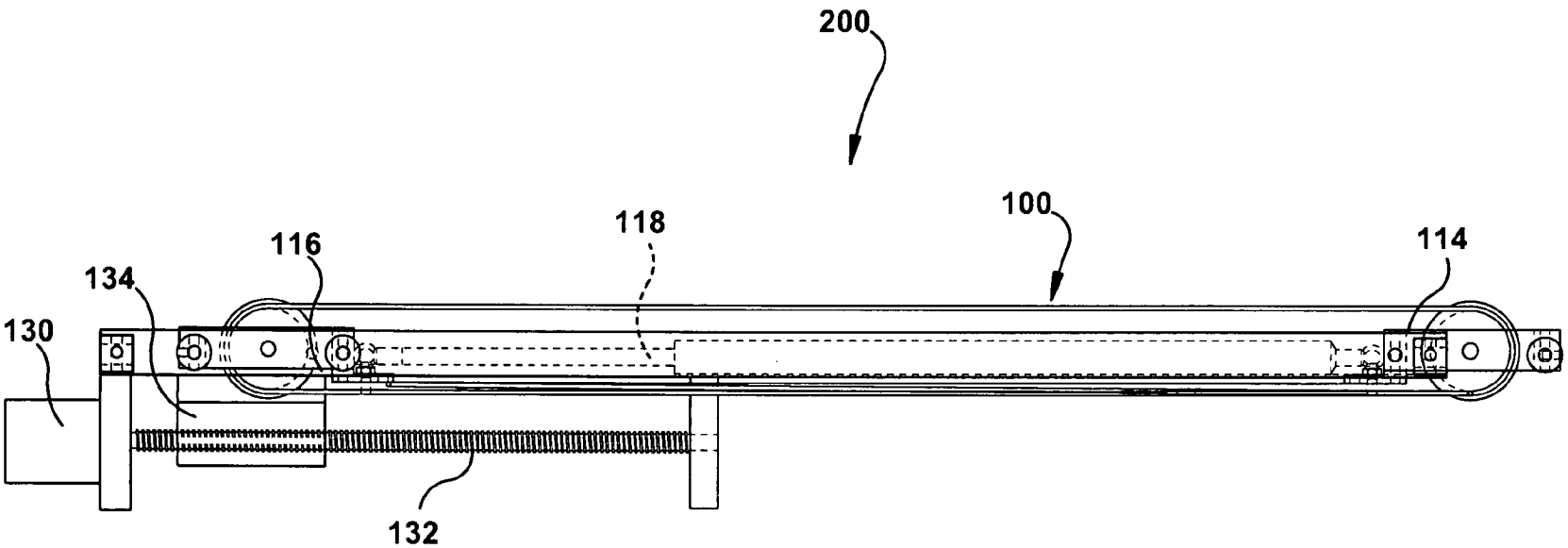
FIG. 20 is a side view of the modular garage door counterbalance assembly of FIG. 16 coupled to a motor and a lead screw.

FIG. 20 illustrates the modularity of the modular garage door counterbalance assembly 100. The assembly 100 may be used to retrofit an existing garage door operating system. The assembly 100 may be coupled to an existing motor 130 and lead screw 132 by positioning the assembly 100 near the lead screw 132 and coupling the slideable carriage 116 to the lead screw through a connection block 134. The connection block 134 includes a threaded aperture through which the lead screw 132 is threaded such that the connection block 134 moves laterally (with respect to FIG. 20) as the screw 132 rotates. The lead screw 132 is also coupled to the garage door, by an arm (not shown) or other such device, to raise and lower the door. The coupling of the lead screw 132 to the slideable carriage 116 transfers forces from the energy storing device 118, to assist in opening and closing the garage door. Thus, the assembly 100 may be arranged to store energy, and slow the decent of the garage door, as the garage door is lowered and release energy, to assist in lifting the garage door, as the garage door is raised. This arrangement also assists in the maintenance of garage door operating systems. If the motor or lead screw were to fail, either component can be replaced without affecting the remainder of the system.

The combination of the modular garage door counterbalance assembly 100 with the connection block 134, motor 130, and lead screw 132 creates a second assembly 200. This second assembly 200 may be used to retrofit manually operated garage doors or may be used to replace an existing garage door operating system where the motor or lead screw have failed.

While the invention has been described with reference to the preferred embodiment, and other alternate embodiments also have been disclosed, additional embodiments, modifications, and alternations would be obvious to one skilled in the art upon studying the disclosure and drawings. All of the additional embodiments, modifications, or alterations encompassing the spirit of the invention are claimed by the applicants to the extent that they are within the scope of the appended claims.

I claim:

1. An operating assembly for a door comprising:

a shaft coupled to a door wherein said shaft rotates in a first direction as the door is opened and rotates in a second direction as the door is closed;

a graduated drum coupled to said shaft for rotation therewith, said graduated drum having a groove having a smallest diameter near a first end and a largest diameter near a second end, said graduated drum including a nonlinear portion extending along a major portion of the drum along the axis of the drum substantially from the grooves with the smallest diameter to the grooves with the largest diameter and having at least three consecutive graduations of the groove between the first and second ends, the difference in diameter between the first graduation and the second graduation is different than the difference in diameter between the second graduation and the third graduation;

an energy storing member coupled to said at least partially nonlinearly graduated drum wherein said energy storing member stores energy as the door is closed and releases stored energy as the door is opened wherein said energy storing member is coupled to said nonlinearly graduated drum via a cable, said cable having a first end mounted to the first end of the drum along the smallest diameter of said drum and wrapping at least one and a half revolutions around said drum and connected at the other end to said energy storing member.

2. The operating assembly of claim 1 wherein as said energy storing member releases energy, said energy storing member encourages the rotation of said shaft in said first direction.

3. The operating assembly of claim 1 wherein as said energy storing member stores energy, said energy storing member resists the rotation of said shaft in said second direction.

4. The operating assembly of claim 1 wherein said energy storing member is coupled to said at least partially graduated drum by said cable.

5. The operating assembly of claim 1 wherein said energy storing member is a gas spring.

6. The operating assembly of claim 5 wherein said gas spring includes a fixed first end and a second end moveable with respect to said first end.

7. The operating assembly of claim 6 further comprising:

a first housing member coupled to said second end of said gas spring;

a first sheave located within said first housing;

wherein said cable travels at least partially along said first sheave to couple said gas spring to said at least partially graduated drum.

8. The operating assembly of claim 7 further comprising:

a second housing coupled to said first end of said gas spring; and a second sheave located within said second housing wherein said cable travels at least partially along said second sheave to couple said gas spring to said at least partially graduated drum.

9. The operating assembly of claim 8 wherein as said door is closed, said second end moves towards said first end and as said door is opened, said second end moves away from said first end.

10. A method of assisting in the raising and lowering of a garage door, said method comprising:

providing an energy storing device;

coupling said energy storing device to said garage door through a graduated drum, said drum having a groove having a smallest diameter near a first end and a largest diameter near a second end, said drum including a nonlinear portion extending along a major portion of the drum along the axis of the drum substantially from the grooves with the smallest diameter to the grooves with the largest diameter and having at least three consecutive graduations of the groove between the first and second ends, the difference in diameter between the first graduation and the second graduation is different than the difference in diameter between the second graduation and the third graduation, wherein said energy storing device is coupled to said nonlinearly graduated drum via a cable, said cable having a first end mounted to the first end of the drum along the smallest diameter of said drum and wrapping at least one and a half revolutions around said drum and connected at the other end to said energy storing device;

storing energy in said energy storing device as said garage door is lowered from an open position to a closed position; and releasing energy from said energy storing device as said garage door is raised from said closed position to said open position.

* * * * *